US006543615B2

(12) United States Patent
Lake

(10) Patent No.: US 6,543,615 B2
(45) Date of Patent: Apr. 8, 2003

(54) DEVICE FOR HOLDING WRITING IMPLEMENTS

(76) Inventor: Gary F. Lake, 235 Avenida Del Monte, Bishop, CA (US) 93514

( * ) Notice: Subject to any disclaimer, the term of this patent is extended or adjusted under 35 U.S.C. 154(b) by 0 days.

(21) Appl. No.: 09/907,110

(22) Filed: Jul. 16, 2001

(65) Prior Publication Data

US 2002/0027357 A1 Mar. 7, 2002

Related U.S. Application Data

(60) Provisional application No. 60/219,045, filed on Jul. 18, 2000.

(51) Int. Cl.[7] ..... B65D 85/28

(52) U.S. Cl. ..... 206/371; 206/477; 206/482; 281/30

(58) Field of Search ..... 206/214, 371, 206/477, 478, 480, 482; 281/15.1, 30, 31

(56) References Cited

U.S. PATENT DOCUMENTS

| | | | | |
|---|---|---|---|---|
| 433,938 A | | 8/1890 | Gleeson | |
| 808,596 A | | 12/1905 | Blakeslee | |
| 1,284,407 A | * | 11/1918 | Marzahl | 206/336 |
| 1,343,651 A | * | 6/1920 | Stafford | 206/348 |
| 1,446,741 A | | 2/1923 | Faber | |
| 1,904,572 A | | 4/1933 | Trossell | |
| 2,606,041 A | | 8/1952 | Misiak | |
| 2,656,918 A | * | 10/1953 | Hollis | 206/482 |
| 3,126,891 A | | 3/1964 | Caputi | |
| 3,627,182 A | | 12/1971 | Calkins | |
| 3,927,762 A | * | 12/1975 | Zdarsky et al. | 206/229 |
| 5,386,916 A | * | 2/1995 | Valiulis | 211/113 |
| 5,820,095 A | | 10/1998 | Stone | 248/316.7 |
| 6,009,998 A | * | 1/2000 | Webinger | 206/364 |

* cited by examiner

*Primary Examiner*—David T. Fidei
(74) *Attorney, Agent, or Firm*—James G. O'Neill

(57) ABSTRACT

A device for holding writing implements has an apertured holder pattern formed in a resilient material. The holder pattern has a pair of flat resilient holding arms and aligned entry ports. The entry ports are generally rounded openings of sufficient size to enable a writing implement to be inserted in to cam the holding arms upwardly so as to hold the writing implement in place.

19 Claims, 2 Drawing Sheets

DEVICE FOR HOLDING WRITING IMPLEMENTS

CROSS-REFERENCE TO RELATED APPLICATIONS

This application is entitled to the benefit of Provisional Patent Application Ser. No. 60/219,045, filing date: Jul. 18, 2000.

BACKGROUND

1. Field of Invention

This invention relates to a device for holding writing implements, specifically to such holders that can be adhered onto, or integrated into other things.

2. Description of Prior Art

Often, when a pen or pencil is needed, they simply aren't there. This has been an ongoing problem, from the caves to boardrooms. A notebook without a pen is useless, as is a pencil without paper. They are interdependent, with the lack of availability of the writing implement being the more common problem. Research into prior art hasn't shown a device that can be generalized to deal with the many situations where availability of writing implements is needed. Products being Products developed for the current market lack versatility. In the past the problem has for the most part been ignored, and left to the improvisational instincts of the individual consumer. Consider the ball-point pen slipped into the wire of spiral-bound notebooks, often lost. Consider a pencil held diagonally on a clipboard, under the clip and on top of the paper, and everything falls out. consider the coffee cups around the house, full of pens and pencils, and not always where needed. And, of course, the human ear. These improvisations, and many more, are real indications of a problem that needs to be solved.

Commercial solutions have mostly dealt with the problem on an individual basis; each specific situation receiving a specific solution. There are zippered pocket holders for loose-leaf binders. Holders mounted on clipboards designed for erasable marker pen. And, of course, the pocket-protector. There are loops and sleeves, generally crafted into writing kits or brief cases, generally made of fabrics, plastics, or leather. These iterations often appear to have been designed as an afterthought with low priority, or low budget, or all three. They tend to fall apart, come unstitched, or to stretch out and loose elasticity, all becoming useless.

The most interesting device found in the prior art search is U.S. Pat. No. 5,820,095, John W. Stone, Oct. 13, 1998. It appears to have been initially designed to hold marker pens, and then generalized to hold pens and pencils. The device performs well holding markers in the lecture-demonstration mode, but not as well with smaller writing implements, having the following problems:

a. The device protrudes too high from whatever it is mounted onto. Its highest point from its base is about 1.4 cm, approximately twice the diameter of the typical writing implement it was designed to hold, higher than many common notebooks are thick. Thickness would create problems with stacking, shelving, and when transported in a briefcase.

b. The height of the device from its base remains the same whether a writing implement is in place, or the device is empty.

c. The protruding edges and corners at each end are sharp and obtrusive.

d. The device is made from an extruded material that is not as resilient as it needs to be to hold the variety of sizes as claimed. This lack of resiliency manifests when changing from one size implement to another, especially when changing to a smaller implement.

e. The above criticisms combines to suggest a device that is not as versatile as is needed by the consumer.

SUMMARY

In accordance with the present invention a holding device for writing implements and other implements of similar shape. The essence of the invention is the pattern contained within the device that holds the implements, comprised of entry ports and holding edges. The pattern can be:

a. Contained within a material that is part of something else, such as the cover material of a notebook. Hereafter referred to as the preferred embodiment.

b. Contained minimally within a material, with an adhesive added to the underside, enabling the holding device to be mounted wherever the user deems practicable. Hereafter referred to as embodiment 2.

Objects and Advantages

Accordingly, besides the objects and advantages of the holding device described in my above patent, several objects and advantages are:

a. to provide a device that is versatile. Prior art has not shown a device that can be generalized effectively to deal with the many situations where availability of writing implements is needed: within the cover materials of notebooks, mounted onto the cover of notebooks, mounted onto or around computers, telephones, clipboards, wherever the user thinks is appropriate.

b. to provide a holding device that is easy to use. The visual effect the device has on first sight suggests without instruction: what it does, how the writing implement is removed, and how the writing implement is to be inserted.

c. to provide an ergonomically safe holding device. In the case of the preferred embodiment the writing implement is held flat against the material the device is integrated into. Therefore the height from the base is equal to the diameter of writing implement. In the case of embodiment 2, the height from the base is equal to the diameter of the writing implement plus the thickness of the material the device is made of. The holding edges of both embodiments collapse downward when the writing implement is removed, to approximately 0.5 cm. Additionally, there are no sharp corners or edges to snag or cut anything. Thus a more ergonomically sound device.

d. To provide a holder that physically connects paper and writing implement. The best example is the preferred embodiment, wherein the invention is integrated into the cover material of a notebook. A second example is embodiment 2, wherein the invention is integrated into a body material, and then adhered onto the cover material of a notebook.

e. To provide a holding device that protects the surface mounted upon from being soiled by the implement, or fingers.

f. The width of the area between the holding pattern and the perimeter shape serve To provide an esthetically pleasing device that is easy to see, especially if the color is strongly contrasted with its surroundings. Colors may be used to convey specific information: red for danger, yellow for caution, green for go, etc.

g. Both embodiments provide to remind the user whether or not there is a writing implement at hand.

h. To provide a holding device that can be made from a variety of materials and processes. Both embodiments could be manufactured from various plastics, and papers, or other materials that are flexibly, and resiliently suitable. processes of manufacture would be those suitable to the material, injection molding, die-cutting are the most obvious for plastics and papers.

i. To provide a holding device of embodiment 2 that allows the user to choose where to mount the device, onto: books and notebooks, computers, telephones, kitchens, workshops, dashboards, wherever the user thinks appropriate.

j. To provide a holding device of embodiment 2 that can accept commercial printing around the flat perimeter portion, for promotional advertising purposes.

k. To provide a holding device off embodiment 2 that can be modified into other products while maintaining integrity as a holder of writing implements. The perimeter of embodiment 2, in its present form, confines the holding device and adhesive, in a efficient, minimal, and visually pleasing way. For promotional advertising and other product purposes the shape of the perimeter, outside of the adhesive area could be anything a designer might create: trademarks, fictional characters, or information.

l. To provide a holding device which will hold writing implements of various diameters, including most common brands of ball-point pens, and wooden or mechanical pencils.

m. To provide a holding device for writing implements that is inexpensive and durable.

Further objects and advantages of my invention will become apparent from a consideration of the drawings and ensuing descriptions.

DRAWING FIGURES

Figure 10:
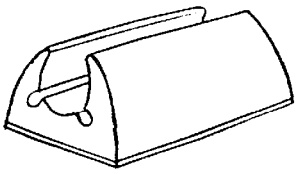
Fig.10 Prior Art

FIG. 10 shows prior art—U.S. Pat. No. 5,820,095 Stone Oct. 13, 1998.

NUMERALS IN DRAWINGS

| | |
|---|---|
| 20 | holder pattern |
| 22 | entry port |
| 24 | entry port point |
| 26 | entry port curve |
| 28 | holding arm |
| 30 | holding edge |
| 32 | impressed line |
| 34 | holder base |
| 36 | holder body |
| 38 | adhesive pattern |
| 40 | rounded corner |
| 42 | hinging area |
| 44 | perimeter |
| 46 | channel |
| 48 | longitudinal ridge |
| 50 | holding fingers |
| 52 | tortuous edges |
| 54 | tortuous path |

DESCRIPTION OF PREFERRED EMBODIMENTS

Figure 2:
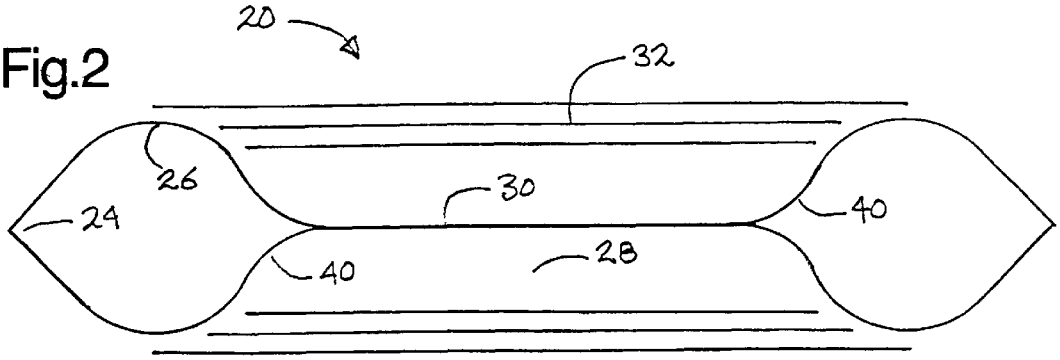
FIG. 2 shows an enlarged top view of the pattern of the preferred embodiment.

The invention described herein is a device for holding writing implements that is operative in two distinctly different applications, both evolving from the holder pattern 20 illustrated in FIG. 2. The preferred embodiment is integrated into something else, embodiment 2 is adhered onto something else.

Figure 1:
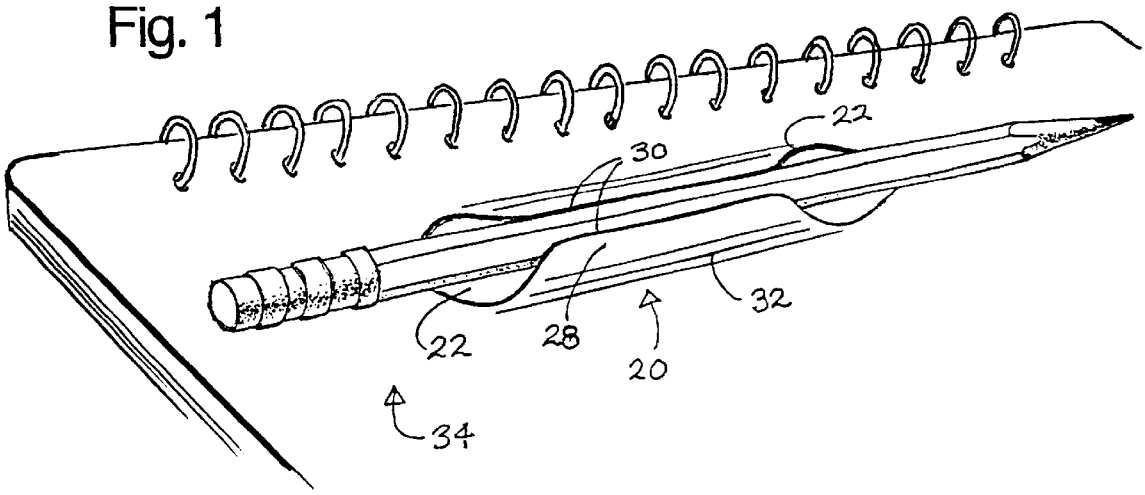
FIG. 1 shows a top perspective of the preferred embodiment integrated into the cover material of a spiral-bound notebook, with pencil inserted.

The preferred embodiment is essentially a pattern cut or molded into a suitable material that is part of something else. FIG. 1 shows the device integrated into the cover material of a spiral bound notebook, with a pencil in place. FIG. 2 is an enlargement of the holder pattern 20 comprising: two entry ports 22, two combination holding arms 28 and holding edges 30, and two sets of impressed lines 32. The two sets of combined holding arms 28 and holding edges 30 arc mirror imaged and contiguous and connect to mirror imaged entry ports 22 at each end. The configuration looks like a thin spear shaft with a spearhead at both ends: entry ports 22 represented by the opposite pointing spearheads, contiguous holding edges 30 represented by the connecting spear shaft. A plurality of mirror imaged impressed lines 32 parallel holding edges 30 between the outer arcs of each entry port 22. Holder pattern 20 is symmetrical in vertical and horizontal orientation.

Figure 3:
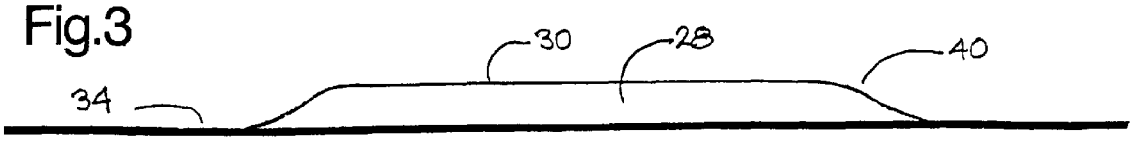
FIG. 3 shows an enlarged side view of the preferred embodiment.
Figure 4A:
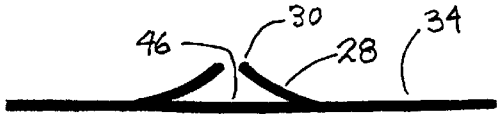
FIG. 4A shows an enlarged end view of the preferred embodiment.
Figure 4B:
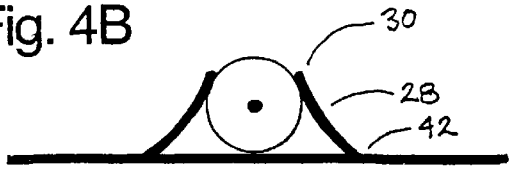
FIG. 4B shows an enlarged end view of the preferred embodiment with a ball-point pen inserted

Entry port 22 is a void in the cover material of FIG. 1 and FIG. 2 comprising the entry port point 24, and entry port curve 26, and rounded corners 40. The area of the entry port 22 is defined by: two lines diverging from a point on an axis, in a mirrored, symmetrical fashion, at about 45 degree angles. The angles end as they connect with the outermost perimeter of a concentric circle, curving back and ending on the line of the axis. There is a mirrored, and opposite entry port 22 on the axis some distance away. A line cut through the holder base 34 material along the line of the axis connects the two entry ports 22, and defines the contiguous holding edges 30. FIG. 3 shows a rounded corner 40 operative a transition between entry port 22 and holding edge 30. Impressed lines 32 are a plurality of lines pressed into the area of transition between the holder base 34 and the holding arm 28, and are longitudinally centered between, but not touching, the outer part of entry port curves 26.

FIGS. 1 thru 4B show various views of holding arms 28, and holding edges 30. Holder pattern 20 comes to the consumer in a flat manner, planar to the holder base 34 material. Holding edges 30 are contiguous. Holding edges 30 are the terminal edges of holding arms 28, terminating on the axis line. The holding edges transition into the entry ports at rounded earners 40. The holding arms begin approximately on a line between the curved outer portion of the entry ports, along the longitudinal impressed lines 32. As best shown in FIG. 4A, before an implement is inserted the holding arms angle slightly upward toward each other and are slightly open. When an implement is inserted, best seen in FIG. 48, the holding arms are forced upward and outward, thus creating the clamping force.

FIGS. 1 and 2 show impressed lines 32. The impressed lines are very shallow impress-ions formed into the holder body material as the holder pattern is being manufactured, operative to the consumer preparing the holding arms 28 for use. when the material the holder pattern is being integrated into is paper, impressed lines 32 create a hinging area 42 that facilitate forming holding arms 28. The use of impressed lines 32 may be included or excluded on various applications of all embodiment.

Summarizing: A channel 46, triangular in cross section, is created between holding edges 30 and holder base 34 that are in direct contact with the writing implement, and form a three-point clamping action.

The preferred embodiment herein has used a notebook application to illustrate its many advantages, considered a best-use application. Many other applications are possible that integrate into the body material of other manufactured things, the potential to hold writing implements.

Operations—Preferred Embodiment

FIGS. 1 thru 4B show a device for holding writing implements that has been integrated into something else. FIG. 1 is a top perspective view with a pencil intact. The application used here to illustrate the operation of embodiment 1 is a spiral-bound notebook, considered to be a best-use, but is not to be considered as limiting in any other applications.

The notebook would come to the consumer with holder pattern 20 most likely die-cut through the cover material, flat and planar. In cover materials made of paper the pattern would be flanked by impressed lines 32. Impressed lines 32 facilitate the forming of holding arms 28, and holding edges 30, that prepare the device for holding. The holding arms and edges are formed by: Partially open the cover and insert a pen or pencil down into either entry port 22; slide the pen under holding edges 30, along channel 46, up and out of the opposite entry port, longitudinally centering the pen in the holding edges 30; permanently form the holding arms and edges by simultaneously rubbing, with thumb and forefinger, firmly along impressed lines 32. The pen or pencil may be removed from the holding device by: gripping the implement at either end, lifting it perpendicularly, forcing the holding edges apart, freeing the implement; or by sliding the implement, parallel with the axis, out through either entry port. A pen or pencil may be inserted into the holding device by: Hold the implement near parallel to the axis at either entry port; insert the implement's point into channel 46, under and along the holding edges; slide the implement along the channel and out through the opposite entry port. Thus is provided a notebook with a built-in pen or pencil holder.

Figure 5:
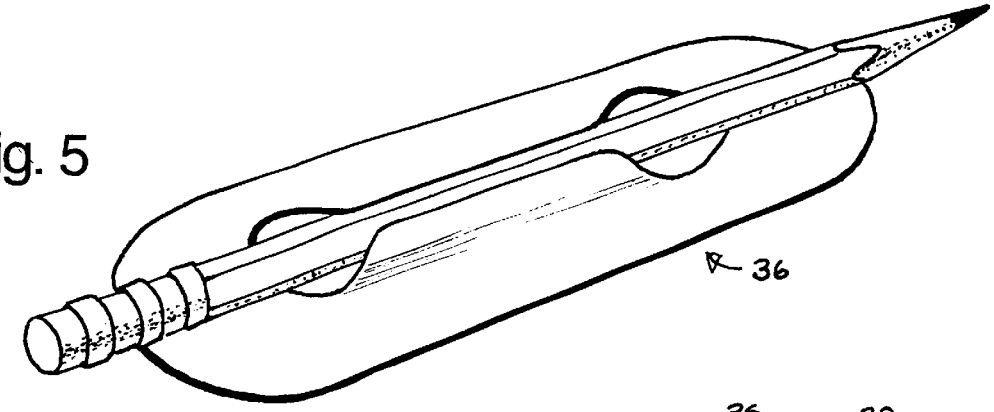
FIG. 5 shows a top perspective view of embodiment 2 with a pencil inserted.
Figure 6:
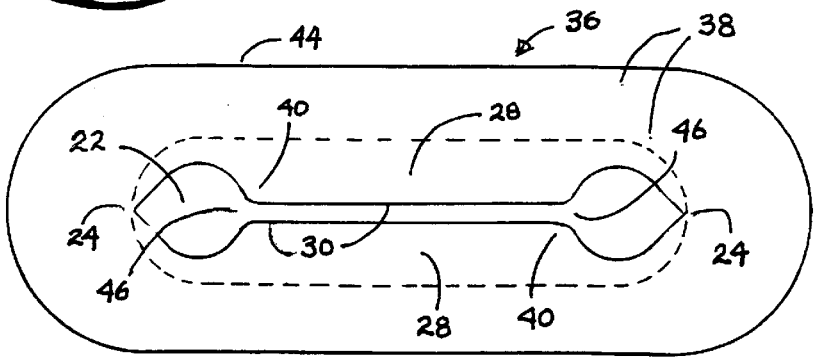
FIG. 6 shows a top view of embodiment 2, including the adhesive pattern.
Figure 8:
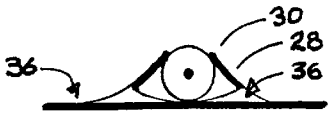
FIG. 8 shows an end view of embodiment 2, with a writing implement inserted.

Description Embodiment 2—FIGS. 5, 6, and 8

Embodiment 2 is a device for holding writing implements that can be adhered onto something else. FIG. 5 shows a top perspective view of my invention with a pencil in place. Embodiment 2 uses the holder pattern 20 of the preferred embodiment, and surrounds the pattern with a holder body 36. Holder body 36 is an elongated oval shape with flattened sides, made from a thin, flexibly resilient, material, approximately the thickness of a credit card. A perimeter shape 44 is considered efficient to surround holder pattern 20 and provide an area on the underside for the adhesive. As shown in FIG. 6 an adhesive pattern 38 is defined by the area just outside of holder pattern 20 outward to the perimeter of the holder body. Thus operative to adhere the device for holding writing implements anywhere the consumer thinks practicable. As best seen in FIG. 8 the implement is held within the device at three points, the two holding edges 30 and holder body 36.

Operations—Embodiment 2

Figure 9:
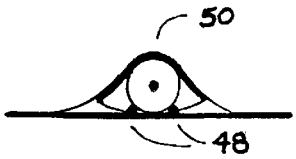
FIG. 9 shows an end view of embodiment 3 including longitudinal ridges, and holding fingers looped over the inserted writing implement.

FIGS. 5, 6, and 9 show a device for holding writing implements that can be adhered to something else. FIG. 5 shows holder pattern 20 surrounded by a holder body 36, with an adhesive 38 on the underside covered by a protective material. Thus enabling the device to be mounted wherever the consumer thinks appropriate: walls, calendars, notebooks, wherever. Embodiment 2 would be mounted onto the cover of a spiral-bound notebook in the following way: select the positioning of the device and insert a pen or pencil; remove the protective covering from the adhesive; holding both ends of the pencil, carefully reposition the holder device and press down; remove the pencil from the holder and thoroughly rub the adhesive down.

Figure 7:
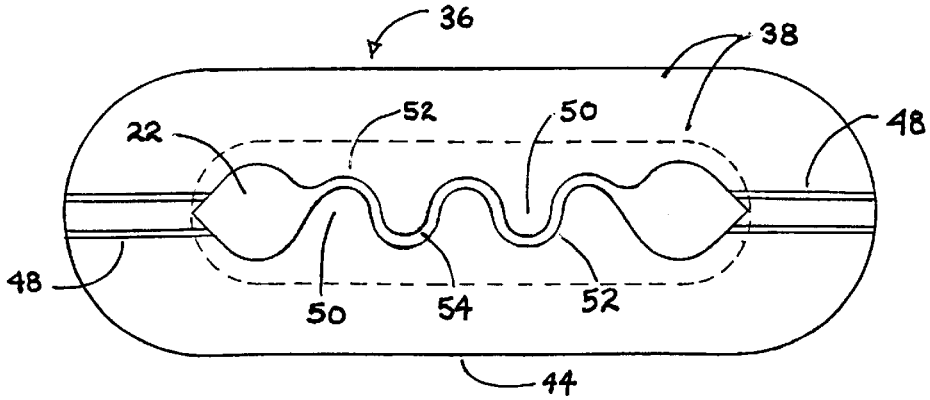
FIG. 7 shows a top view of the alternative pattern of holding edges, and longitudinal ridges, of embodiment 3

Description Embodiment 3—FIGS. 7 and 9

Embodiment 3 is a modification of embodiment 2 and is a device for circumstances calling for a very high degree of holding potential. FIG. 7 shows a top view of the modifications of embodiment 3. The heretofore straight path between holding edges 30 becomes a tortuous path 54. Holding arms 28 transition into a plurality of holding fingers 50 that terminate as a tortuous edge 52. From opposite sides a plurality of holding fingers 50 curve up over and slightly down the top portion of channel 46, alternately, like interlaced fingers, greatly increasing holding power. FIG. 9 shows an end view with a writing implement inserted, indicating the overlapping of the holding fingers 50. The holding arms and fingers collapse downward when the implement is removed.

FIGS. 7 and 8 show a pair of small longitudinal ridges 48, about 1.5 mm high, formed up out of holder body 36, approximately 1 cm apart, paralleling the axis of the holder body, and extending from perimeter 44 axially, to the opening of entry port 22. When a writing implement is inserted longitudinal ridges 48 flank the implement, laterally stabilizing the implement along the line of the axis.

Summarizing: A channel 46, is created between holding fingers 50 and holder body 30 that come directly in direct contact with the writing implement, and form a surrounding clamping action.

Operations—Embodiment 3

FIGS. 7 and 9 show two modifications to embodiment 2 for special circumstances where a higher degree of holding power is desired:

1. A mirrored pair of longitudinal ridges 48 are formed into the holder body 36 at both arched ends. Longitudinal ridges operative to restrict the lateral motion of the writing implement, providing more security.
2. Modified holding edges, defined by tortuous edges that look similar to interlaced fingers; looping over the implement providing more security. It is recommended that the writing implement be removed by sliding it out of either entry port; the reverse of the entry procedure.

Conclusion, Ramifications, and Scope

Thus the reader will see that the invention described herein provides a device for holding writing implements that is easy to use, reliable, and highly versatile in its application. A device that everyone who writes could find useful. While my above description contains three embodiments and many specificities, these should not be construed as limitations on the scope of the invention, but rather as exemplifications of the three embodiments thereof. Many other variations are possible. For example:

a. Modify the present devices to hold a plurality of writing implements. Other embodiments could hold two or many more implements, for artists or students.

b. Modify the embodiments to hold a variety of implement sizes.

c. Embodiment 2 wherein the holder body is modified to carry books and notebooks for recording and displaying information.

d. A combination notebook-pencil holder-pocket protector that can be folded and fit into purse or pocket, and protect each from the other.

e. Embodiment 2 and 3 may include a clip device rather than an adhesive. The device would then be transferable.

f. Embodiment 2 and 3: may extend the two lobes of the holder body sufficiently to shield whatever the holder body is mounted on from the writing implement.

I claim:

1. A writing implement holding device comprising:

a flat base made from a resilient material;

a pattern formed in the flat base along an axis of the flat base; and the pattern having a pair of open entry ports formed at opposed ends of a pair of resilient holding arms terminating in mating holding edges, whereby a writing implement inserted into either of the pair of open entry ports will cam the resilient holding arms away from the flat base to form a channel wherein the holding edges will resiliently grip a writing implement.

2. The writing instrument holding device of claim 1 wherein the flat base is a notebook cover.

3. The writing instrument holding device of claim 2 wherein the open entry ports arc sized and dimensioned to facilitate insertion of writing implement therein.

4. The writing instrument holding device of claim 3, further including a plurality of impressed lines formed in a first side of the flat base parallel to the axis on either side of the holding edges.

5. The writing instrument holding device of claim 4 wherein the mating holding edges are substantially straight.

6. The writing instrument holding device of claim 4 wherein the mating holding edges form overlapping holding fingers.

7. The writing instrument holding device of claim 1, further including an adhesive secured to a second side of the flat base.

8. The writing instrument holding device of claim 7 wherein the open entry ports are sized and dimensioned to facilitate insertion of writing implement therein.

9. The writing instrument holding device of claim 8 further including a plurality of impressed lines formed in a first side of the flat base parallel to the axis on either side of the holding edges.

10. The writing instrument holding device of claim 9 wherein the mating holding edges are substantially straight.

11. The writing instrument holding device of claim 10 wherein the mating holding edges form overlapping holding fingers.

12. A writing instrument holding device comprising:

a flat base made from a resilient material;

the flat base having a top surface and a bottom surface with a pattern formed therein extending between the top surface and the bottom surface along a longitudinal axis of the flat base;

the pattern formed in the flat base having a pair of flexible holding arms terminating in mating holding edges aligned with the longitudinal axis and a pair of entry ports formed at opposed ends of the mating holding edges; and a plurality of impressed lines formed in the top surface parallel to the axis on either side of the holding edges, whereby a writing implement inserted into either of the open entry ports will cam the flexible holding arms away from the top surface to form a channel wherein the holding edges will resiliently grip a writing instrument.

13. The wilting implement holding device of claim 12 wherein the flat base is a notebook cover and the open entry ports are sized and dimensioned to facilitate insertion of writing implement therein.

14. The writing implement holding device of claim 13 wherein the mating holding edges are substantially straight.

15. The writing implement holding device of claim 14 wherein the mating holding edges form a tortuous path with interlaced fingers.

16. The writing implement of claim 12, further including a layer of adhesive secured to the bottom surface.

17. The writing implement holding device of claim 16 wherein the mating holding edges are substantially straight.

18. The writing implement holding device of claim 17 wherein the mating holding edges form a tortuous path with interlaced fingers.

19. A writing instrument holding device comprising:

a flat base made from a resilient material;

the flat base having a top surface and a bottom surface with a pattern formed therein extending between the top surface and the bottom surface along a longitudinal axis of the flat base;

the pattern formed in the flat base being die cut to form a pair of flexible holding arms starting at a plurality of impressed lines formed on the top surface and terminating in holding edges aligned with the longitudinal axis and a pair of entry ports having curved side edges and angled ends formed at opposed ends of the holding edges; and the plurality of impressed lines formed on the top surface being parallel to the axis and on either side of the holding edges, whereby a writing implement inserted into either of the open entry ports will cam the flexible holding arms away from the top surface to form a channel wherein the holding edges will resiliently grip a writing instrument.

* * * * *